US005353530A

United States Patent [19]

Pieper

[11] Patent Number: 5,353,530

[45] Date of Patent: Oct. 11, 1994

[54] QUICK MOUNTING SNOW PLOW ASSEMBLY

[75] Inventor: James C. Pieper, Spruce Head, Me.

[73] Assignee: Douglas Dynamics, Inc., Milwaukee, Wis.

[21] Appl. No.: 939,331

[22] Filed: Sep. 2, 1992

[51] Int. Cl.[5] ..... E01H 5/04

[52] U.S. Cl. ..... 37/231; 37/271

[58] Field of Search ..... 37/231, 234, 235, 236, 37/266, 279, 270, 271, 468

[56] References Cited

U.S. PATENT DOCUMENTS

| | | | |
|---|---|---|---|
| 4,236,329 | 12/1980 | Hetrick | 37/231 |
| 4,342,163 | 8/1982 | Hoekstra | 37/231 |
| 4,962,599 | 10/1990 | Harris . | |
| 4,991,323 | 2/1991 | Benkler | 37/231 X |
| 5,075,988 | 12/1991 | Ciula . | |
| 5,125,174 | 6/1992 | Watson et al. | 37/235 X |
| 5,136,795 | 8/1992 | Rosenberg | 37/235 X |
| 5,142,801 | 9/1992 | Feller | 37/235 |
| 5,155,929 | 10/1992 | Vachon | 37/231 X |

*Primary Examiner*—Randolph A. Reese
*Assistant Examiner*—J. Russell McBee
*Attorney, Agent, or Firm*—R. J. Bunyard; R. H. Johnson; L. A. Fillnow

[57] ABSTRACT

Detachably connecting a snow plow assembly (20) to a vehicle (22). The snow plow assembly includes a vehicle mount frame (28) and a lift assembly (30). The mount frame is for connecting to a vehicle frame (26) behind a front bumper (24). The lift assembly includes an A-frame (42) and a lift frame (44) with the forward end (70) of the A-frame for supporting a snow blade (40). Means (75) is provided for pivotally connecting a rear end (74) of the A-frame to the lift frame so that the A-frame is free to rotate relative to the lift frame. Additional means (82) is provided for releasably connecting the lift frame to the mount frame whereby the lift assembly can be attached to or detached from the mount frame as a single unit while leaving the mount frame connected to the vehicle. Preferred embodiments include connecting means (82) being provided with a U-shaped channel (84) having means (88) for horizontally aligning the mount frame relative to the channel when attaching the lift frame to the mount frame, the mount frame provided with means (96) for vertically guiding the U-shaped channel into a slot (104) on the mount frame, the mount frame being connected to the channel by a retractable spring pin (86) and the lift frame including an actuator (56) for raising and lowering the A-frame and the snow blade.

11 Claims, 7 Drawing Sheets

QUICK MOUNTING SNOW PLOW ASSEMBLY

BACKGROUND OF THE INVENTION

The invention relates generally to a snow plow assembly for mounting on a vehicle. More particularly, the invention relates to attachment and detachment of a lift assembly to the vehicle as a single unit.

It is desirable to provide a snow plow assembly with a mechanism affording attachment and detachment to a vehicle. The vehicle owner may wish to remove the snow blade during times when the need for plowing snow arises infrequently or when the vehicle is used for purposes other than plowing snow.

Conventional detachable snow plow assemblies generally provide a mount frame for permanent attachment to a frame of the vehicle, a snow blade attached to an A-frame which, in turn, can be releasably connected to the mount frame and an actuator for raising and lowering the A-frame. The mount frame is located on the front end of the vehicle generally behind the vehicle front bumper. The A-frame and attached snow plow generally are removable from the vehicle but the actuator, usually a relatively heavy hydraulic unit, normally remains attached to the vehicle. Leaving the actuator on the vehicle, when the remainder of the snow plow assembly is removed, exposes the actuator to the elements and possible damage. The permanently mounted, relatively heavy actuator also places the front of the vehicle under additional loading and can reduce the operational life of the vehicle suspension. Leaving the actuator on the vehicle also reduces fuel efficiency of the vehicle.

When plowing snow, it sometimes is desirable to push the snow into a pile. The A-frame of the snow plow assembly must be free to pivot upwardly relative to the vehicle so that the snow blade attached to the A-frame can rise up the slope of the snow pile. Another problem with conventional detachable snow plow assemblies is that the mounting frame and components supported thereby are located in a position interfering with the free upward movement of the A-frame, thereby diminishing the capacity of the snow plow lift assembly to pile snow.

Another problem associated with conventional snow plow assemblies is that the attachment and detachment of the assembly to the vehicle can require lifting of the A-frame and connection of various elements of the snow plow assembly to a mount frame. Such lifting, attachment and detachment of the snow plow assembly can be cumbersome and difficult.

Patent application Ser. No. 07/686,123; incorporated herein by reference, discloses a snow plow assembly overcoming most of the aforesaid problems. The snow plow assembly, including an actuator, is releasably disconnected from a vehicle mount frame as a single unit with the mount frame remaining connected to the vehicle. None of the mount frame extends forward of the vehicle bumper. Nevertheless, a disadvantage associated with having the mount frame attached to the underside of the vehicle at a position behind the vehicle bumper is one of poor operator visibility when mounting the snow plow assembly to the vehicle. With the snow plow assembly supported on the ground surface, the operator maneuvers the vehicle until it appears the vehicle mount frame is aligned with a mounting clevis on the lift assembly. The operator then drives the vehicle forward until the mount frame engages the mounting clevis. Unless an assistant operator is available, the operator then must get out of the vehicle and visually check to determine if the mount frame and mounting clevis are aligned. If not, the operator continues maneuvering the vehicle until alignment occurs.

Accordingly, there remains a need to provide a snow plow lift assembly allowing removal of all structural elements forward of the vehicle bumper as a single unit when the lift assembly is detached from the vehicle but provides easy alignment by a single operator when being attached to the vehicle. There also remains a need to provide a snow plow lift assembly which requires neither manual lifting when being attached or detached from the vehicle nor a heavy lift frame. There further remains a need to provide a snow plow lift assembly which allows easy access to all mechanisms requiring manual operation and has no removable parts.

SUMMARY OF THE INVENTION

The invention relates to a lift assembly for detachably connecting a snow plow assembly to a vehicle. The snow plow assembly includes a vehicle mount frame and a lift assembly. The mount frame is for connecting to a vehicle frame behind the vehicle front bumper. The lift assembly includes an A-frame and a lift frame with the front end of the A-frame for supporting a snow blade. The lift frame includes means for pivotally connecting the rear end of the A-frame to the lift frame whereby the A-frame is free to rotate relative to the lift frame and means for releasably connecting the lift frame to the vehicle mount frame for affording removal of the lift assembly from the mount frame as a single unit so as to leave the mount frame on the vehicle.

An object of the present invention is to provide a snow blade and a lift assembly, both of which can be attached and detached from the front of a vehicle as a single unit.

Another object of the invention is to provide a lift assembly that does not require a heavy lift frame to be attached to the vehicle.

Another object of the invention is to provide a lift assembly which can be attached and detached from a vehicle without cumbersome manual lifting.

Another object of the invention is to provide a snow plow assembly which can be attached and detached from a vehicle by a single operator.

Another object of the invention is to provide a lift assembly including means for vertically and horizontally aligning a detached lift assembly relative to a vehicle when connecting the lift assembly to the vehicle.

Another object of this invention is to provide a lift assembly, when detached from a vehicle, removes all structural elements forward of the bumper.

A feature of the invention is a snow plow assembly including a mount frame and a lift assembly, the mount frame for connection to a vehicle frame, the lift assembly including an A-frame and a lift frame with the front end of the A-frame for supporting a snow blade, the lift frame including means for pivotally connecting the rear end of the A-frame to the lift frame so that the A-frame is free to rotate relative to the lift frame and means for releasably connecting the lift frame to the mount frame allowing removal of the lift assembly from the vehicle mount frame as a single unit so as to leave the mount frame on the vehicle.

Another feature of the invention is for the aforesaid releasably connecting means to include a channel, the channel including means for horizontally guiding the mount frame into alignment with the channel when connecting the lift frame to the mount frame.

Another feature of the invention is for the aforesaid mount frame to include means for vertically guiding the channel relative to the mount frame when connecting the lift frame to the mount frame.

Another feature of the invention is for the aforesaid releasably connecting means to include a retractable pin.

Another feature of the invention is for the aforesaid pivotally connecting means to include a clevis, the clevis being positioned between the retractable pin and the mount frame.

An advantage of the invention is a snow plow assembly having all structural elements forward of the vehicle bumper being detachable from the vehicle as a single unit and the detached unit easily being aligned with the vehicle mount frame by a single operator without manual lifting when being attached to the vehicle.

Another advantage of the invention is that less weight remains on the vehicle when the snow plow assembly is detached from the vehicle providing less wear on the vehicle and greater fuel efficiency.

Another advantage of the invention is that the majority of the snow plow assembly can be pre-assembled prior to installing the vehicle mount frame.

Another advantage of the invention is that the stylish, aerodynamic appearance of the vehicle is easily restored when the snow plow assembly is not being used.

The above and other objects, features and advantages of the invention will become apparent upon consideration of the detailed description and appended drawings.

DESCRIPTION OF THE DRAWINGS

FIG. 6 is an elevation view of the right side of the lower portion of the lift frame in. FIG. 5, FIG, 7 is a plan view of one embodiment of a mount frame of the invention.

DETAILED DESCRIPTION OF THE PREFERRED EMBODIMENT

Figure 1:
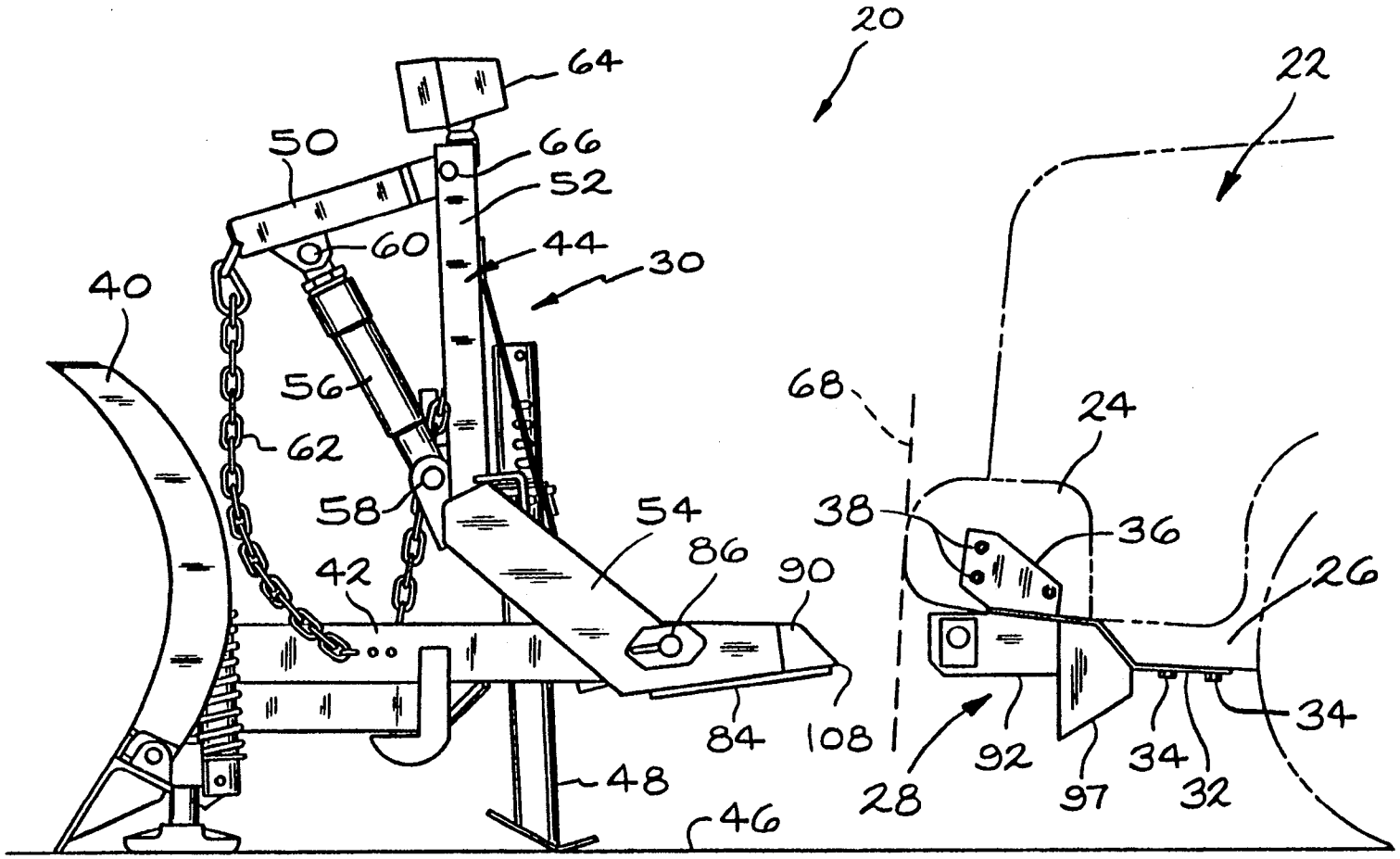
FIG. 1 is an elevation view of one embodiment of a detachable snow plow assembly of the invention with a lift assembly detached from a vehicle mount frame.

Referring to FIG. 1, reference numeral 20 illustrates one embodiment of a snow plow assembly of the invention that is attachable and detachable from a vehicle 22 such as a pickup truck. Vehicle 22 includes a front bumper 24 and a longitudinally extending frame 26. Snow plow assembly 20 includes a mount frame 28 and a lift assembly 30. Mount frame 28 is for connection, preferably permanently, to vehicle frame 26. Mount frame 28 includes means for being connected to vehicle frame 26 such as a horizontal plate 32 fastened to vehicle frame 26 by bolts 34 and a vertical plate 36 fastened to a flange (not shown) on bumper 24 by bolts 38. Lift assembly 30 includes a snow blade 40, an A-frame 42 and a lift frame 44. When detached from a vehicle as a single unit as illustrated in FIG. 1, lift assembly 30 is supported on a ground surface 46 by snow blade 40 and a jack stand 48. Lift frame 44 includes a lift arm 50, an intermediate support 52, a lower support 54, an actuator 56, a chain 62 and a headlamp 64. Actuator 56 is for raising or lowering lift arm 50 and is connected to the lower end of intermediate support 52 by a bolt 58 and pivotally connected to lift arm 50 by a bolt 60. Lift arm 50 is pivotally connected to the upper end of intermediate support 52 by a bolt 66. When actuator 56 operatively raises lift arm 50, snow blade 40 is raised by chain 62. FIG. 1 illustrates lift assembly 30 of snow plow assembly 20 completely detached from vehicle 22 with only mount frame 28 remaining connected to the vehicle. No portion of mount frame 28 is ahead of a forward most vertical point of tangency 68 of bumper 24. That is, mount frame 28 is completely behind the vehicle front bumper. Furthermore, no portion of lift frame 44 extends over the top of bumper 24 (FIGS. 2 and 3) when the lift frame is attached to mount frame 28. The point of attachment of lift frame 44 to mount frame 28 is located behind bumper 24.

Figure 4:
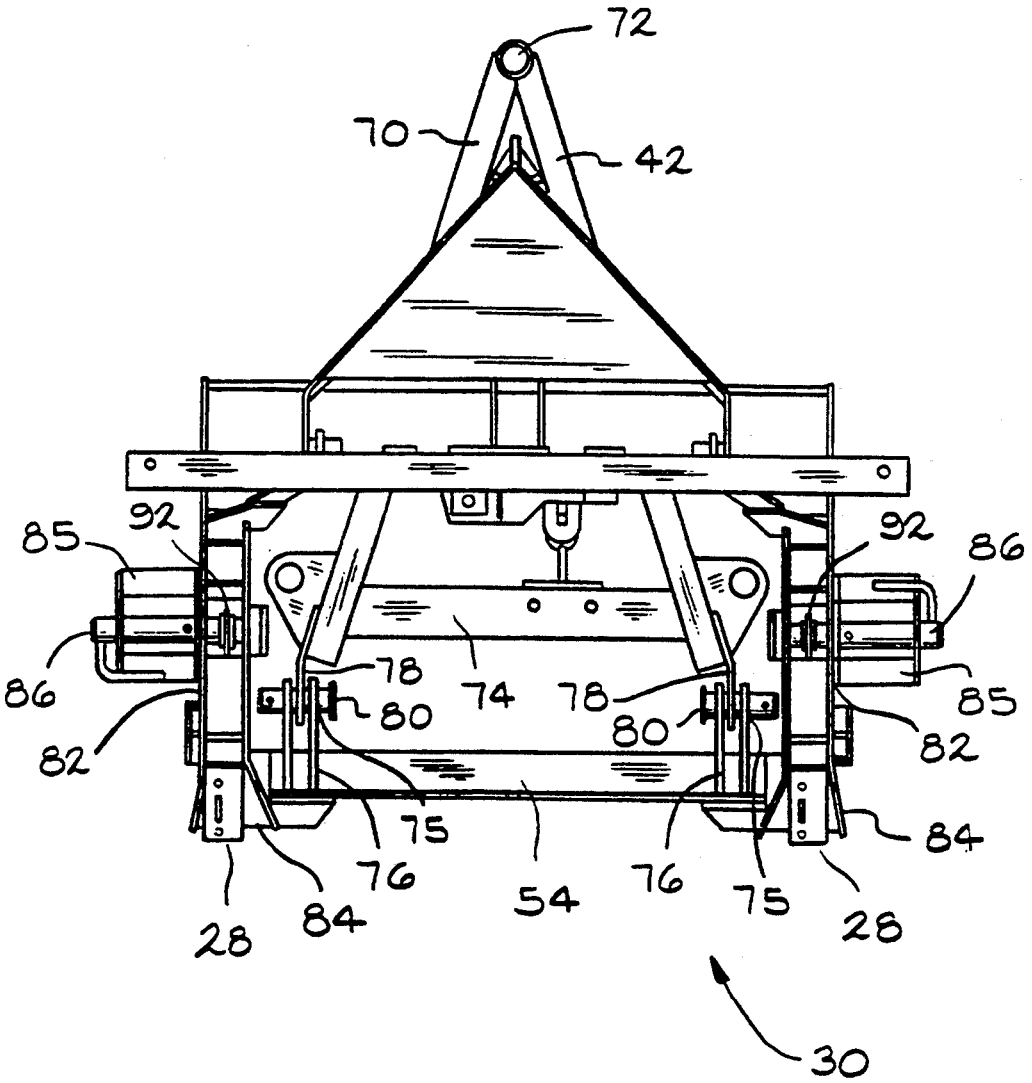
FIG. 4 is a plan view of the snow plow assembly in FIG. 3 with the snow blade removed.

FIG. 4 illustrates a plan view of the snow plow assembly in FIG. 1 with snow blade 40 removed. Snow blade 40 is pivotally connected to the forward end 70 of A-frame 42 to a ring 72. Lower support 54 includes means 75 such as a pair of spaced clevises 76 for connecting the rear end 74 of A-frame 42 to lower support 54. Each side of rear end 74 of A-frame 42 includes a flange 78 having an opening, each flange pivotally connected to one of clevises 76 by a pin 80. Snow blade 40 and A-frame 42 freely rotate relate to clevises 76 of lower support 54 when raised or lowered by actuator 56. Lower support 54 further includes means 82 for connecting lift assembly 30 to mount frame 28. In the embodiment illustrated in FIG. 4, connecting means 82 includes a pair of U-shaped spaced channels 84 and a pair of lugs 85 each for carrying a spring biased retractable pin 86 connected to the outside of each of the channels. Each U-shaped channel 84 is defined by a pair of upstanding legs connected by a lower bright portion with the legs extending in the direction of travel of vehicle 22. The embodiment illustrated in FIG. 4 includes a spaced pair of mount frames 28 with one of the mount frames aligned with and connected to one of channels 84 by retractable pin 86 and the other of the mount frames aligned with and connected to the other of channels 84 by another retractable pin 86.

Figure 5:
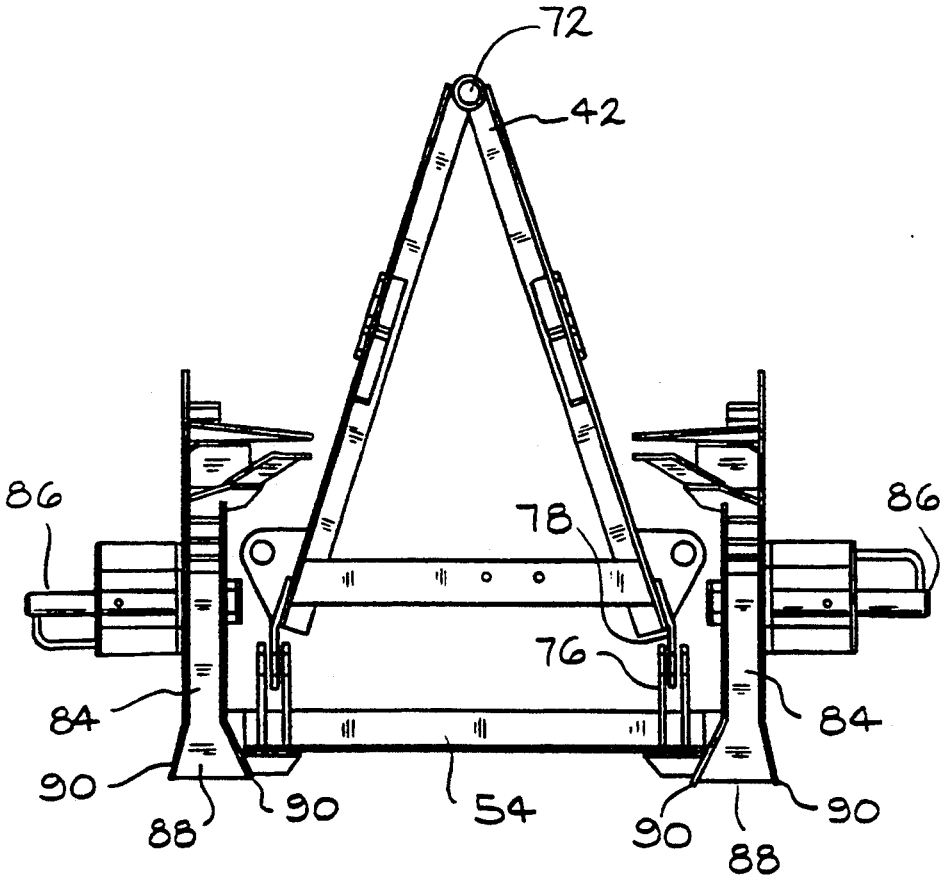
FIG. 5 is a plan view of the lift assembly in FIG. 1 with several parts removed.

FIG. 5 illustrates a plan view of lift assembly 30 of FIG. 1 with each of lift arm 50, intermediate support 52, actuator 56 and chain 62 removed. Lower support 54 of lift frame 44 is detached from each mount frame 28, pins 80 have been removed and spring pins 86 are illustrated in their retracted position.

Figure 6:
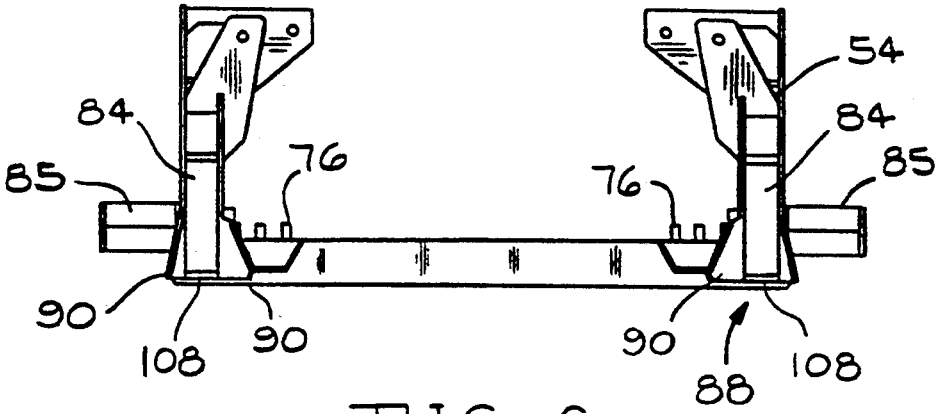

FIG. 6 illustrates an elevation view of the right side of lower portion 54 of lift frame 44 in FIG. 5. Connecting means 82 preferably includes means 88 for horizontally aligning each mount frame 28 with one of channels 84 when the lift frame is being attached to the vehicle frame. In the embodiment illustrated, alignment means 88 includes a pair of spaced guides 90, each guide tapering in an outwardly direction.

Figure 7:
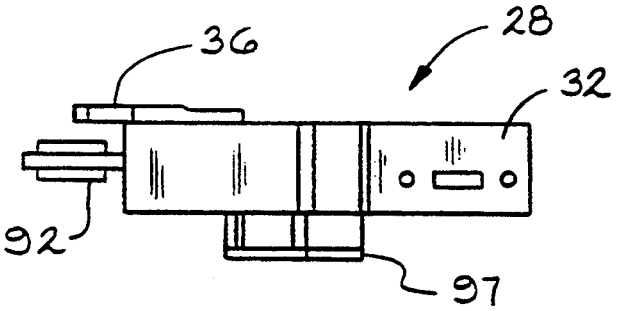
Figure 8:
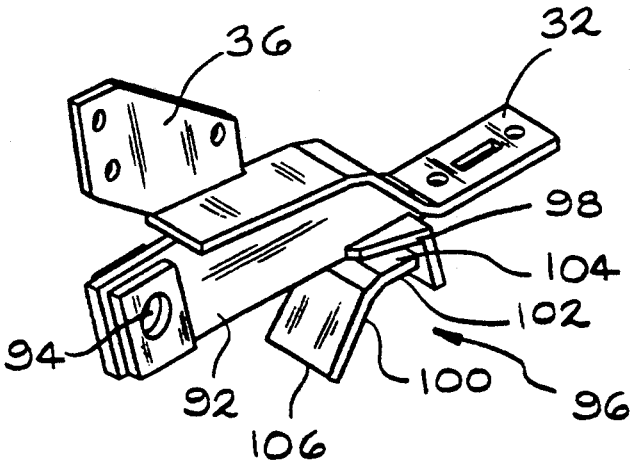
FIG. 8 is a perspective view of the mount frame in FIG. 7.

FIGS. 7 and 8 illustrate mount frame 28 preferably including a pushplate 92 and means 96 for vertically aligning mount frame 28 with channel 84 when the lift frame is being attached to the vehicle frame. In the perspective view of FIG. 8, a cover plate 97 has been removed for clarity. Pushplate 92 includes an opening 94 for receiving retractable pin 86. Alignment means 96 includes an upper plate 98 and a lower plate 100. Lower plate 100 includes a horizontal portion 102 and a downwardly extending portion 106. Horizontal portion 102 is spaced away from upper plate 98 for forming a slot 104. When lift assembly 30 is attached to mount frame 28, a forward extending support lip 108 of channel 84 is received within slot 104 (FIG. 9).

Figure 9:
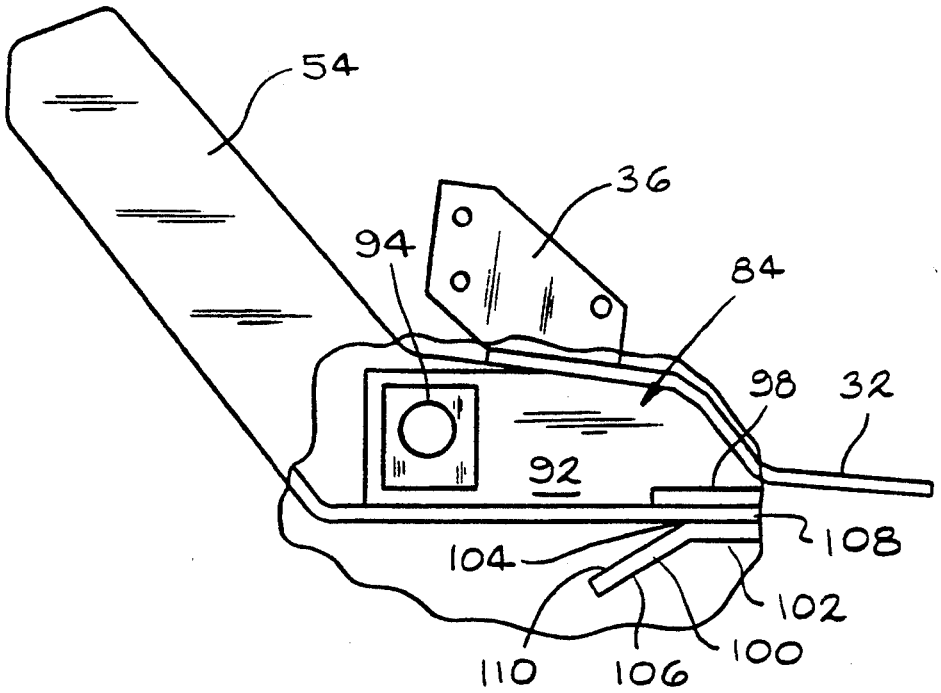
FIG. 9 is an elevation view, partly in section, of the lower portion of the lift frame attached to the vehicle mount frame in FIG. 3.

FIG. 9 illustrates details of lower support 54 of lift frame 44 of lift assembly 30 attached to mount frame 28. If support lip 108 of channel 84 is not aligned with slot 104 when channel 84 is being connected to mount frame 28, an upper sloping surface 110 of portion 106 of plate 100 guides support lip 108 into slot 104. Once retractable pin 86 is passed through opening 94 and connects pushplate 92 to channel 84, lift frame 44 can not rotate relative to retractable pin 86. That is, rotation of lift assembly 30 is prevented when support lip 108 is positioned within slot 104 between plate 98 and portion 102 of plate 100. Retractable pins 86 and slots 104 now are at a position behind point of tangency 68 (FIG. 1 ) of bumper 24.

Figure 2:
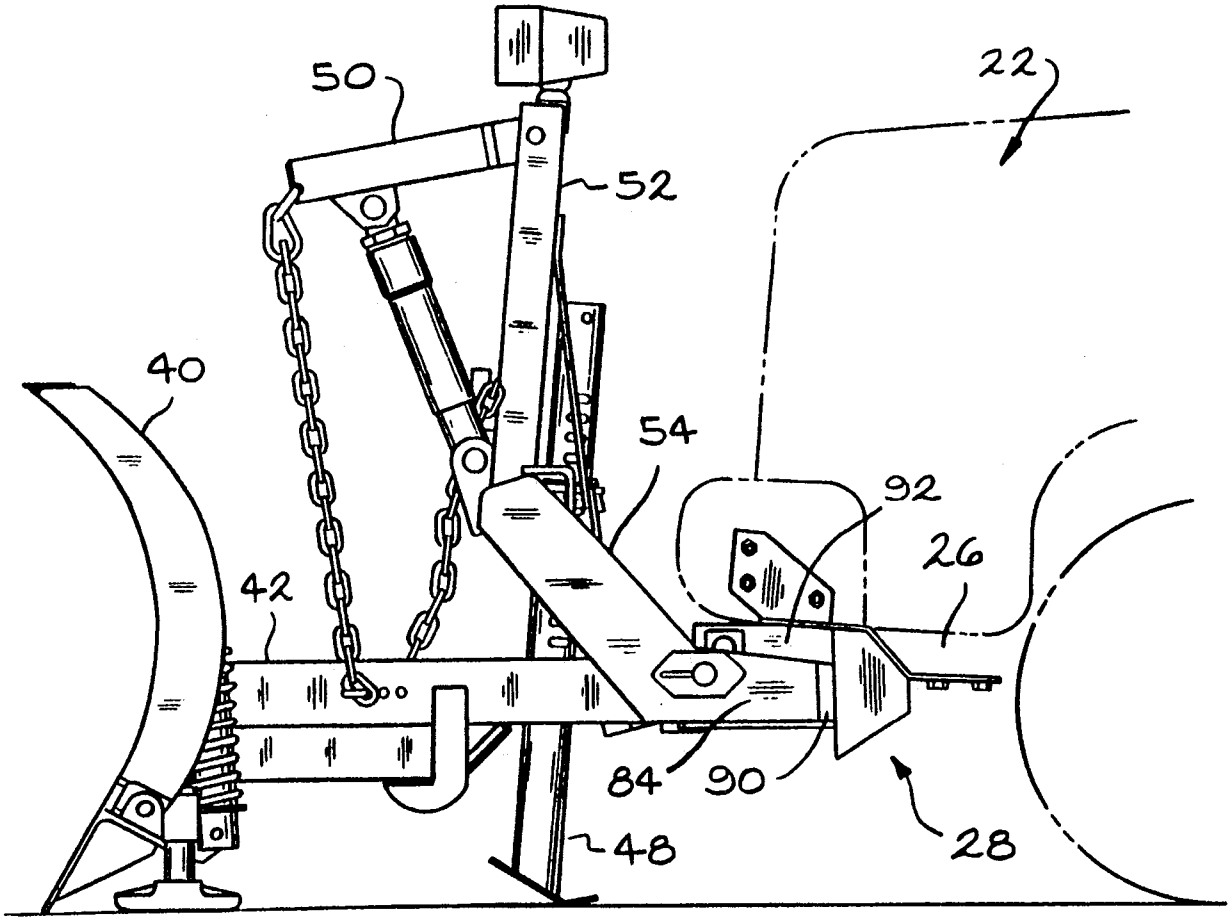
FIG. 2 is an elevation view of the snow plow assembly in FIG. 1 with the lift assembly about to be attached to the vehicle mount frame.
Figure 3:
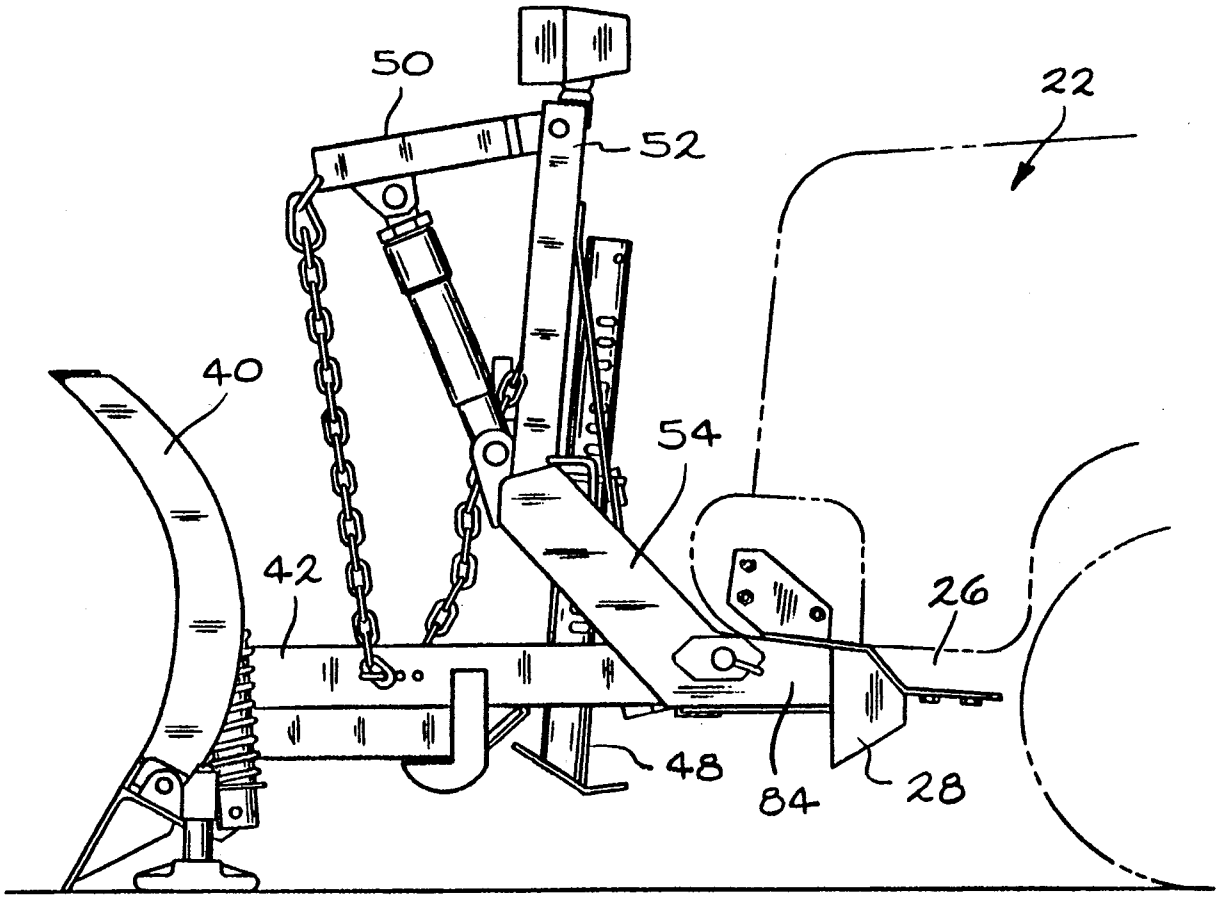
FIG. 3 is an elevation view of the snow plow assembly in FIG. 2 with the lift assembly how attached to the vehicle mount frame.

Attachment and detachment of the lift assembly from the vehicle will now be described by reference to FIGS. 1–3. When it becomes necessary to mount the snow plow assembly to a vehicle, FIG. 1 illustrates an operator driving vehicle 22 toward lift assembly 30 while the lift assembly is supported on the ground surface. As the vehicle is driven slowly toward the lift assembly, the operator maneuvers the vehicle until each of mount frames 28 appears to be longitudinally aligned with one of channels 84 of lower support 54. The operator then continues slowly driving the vehicle toward the lift assembly until pushplate 92 of each mount frame 28 contacts the inside tapering surface of one of guides 90 and/or support lip 108 of channel 84 contacts upper sloping surface 110 of portion 106 of plate 100. This is illustrated in FIG. 2. If support lip 108 is at an elevation above plate 98 or below portion 106 because of an irregular ground surface, the elevation of lower support 54 can be easily adjusted using jack stand 48 and intermediate support 52. Pulling intermediate support 52 forward raises support lip 108. Support lip 108 is guided into slot 104 by the tapering surface of guide 90 and/or the sloping surface of plate 100. As soon as support lip 108 is received by slot 104 and each opening 94 is aligned with the openings in each lug 85, the operator releases the compression of spring biased pins 86. After retractable spring pins 86 are engaged, jack stand 48 can be elevated by the operator since it no longer is necessary to support the lift assembly. This is illustrated in FIG. 3. Lift assembly 30 now is attached to mount frames 28. When it is desired to remove the lift assembly from the vehicle, actuator 56 is operated to lower the snow blade until supported by the ground surface. Jack stand 48 then is lowered into contact with the ground surface. Raising lower support 54 by pushing intermediate support 52 to the rear releases the weight supported by spring pins 86. Once the weight is released, pins 86 are retracted and locked into position as illustrated in FIG. 5. Intermediate support 52 is allowed to rotate forward transferring the weight of the lift assembly from slot 104 to jack stand 48. The vehicle then is backed away from the lift assembly as illustrated in FIG. 1. The lift assembly is detached from the vehicle as a single unit. The only part of the snow plow assembly remaining on the vehicle is the mount frames.

It will be understood various modifications may be made to the invention without departing from the spirit and scope of it. Therefore, the limits of the invention should be determined from the appended claims.

What is claimed is:

1. For use with a vehicle having a frame and a front bumper, a snow plow assembly, comprising:
   - a mount frame for connection to the vehicle frame behind the bumper,
   - a mount frame for connection to the vehicle frame behind the bumper,
   - a lift assembly including an A-frame, a lift frame and a snow blade,
   - the snow blade mounted on the forward end of the A-frame,
   - the lift frame including means for pivotally connecting the rear end of the A-frame to the lift frame whereby the A-frame is free to rotate relative to the lift frame and means for releasably connecting the lift frame to the mount frame affording removal of the lift assembly from the mount frame as a single unit so as to leave the mount frame on the vehicle, and
   - the releasably connecting means including a U-shaped channel located at a position behind the vehicle bumper when the lift frame is connected to the mount frame, the channel defined by a pair of upstanding legs connected by a lower bight portion with the legs extending in the direction of travel of the vehicle.

2. The snow plow assembly of claim 1 wherein the mount frame includes means for vertically aligning the mount frame when connecting the lift frame to the mount frame.

3. The snow plow assembly of claim 1 wherein the releasably connecting means includes a retractable pin.

4. The snow plow assembly of claim 1 including an actuator for raising and lowering the A-frame.

5. The snow plow assembly of claim 4 wherein the lift frame includes a lift arm and an intermediate support,
   - one end of the lift arm pivotally connected to the upper end of the intermediate support,
   - the other end of the lift arm pivotally connected to one end of the actuator,
   - the other end of the actuator connected to the lower end of the intermediate support.

6. The snow plow assembly of claim 1 wherein the alignment means includes a plate having a downwardly extending portion.

7. The snow plow assembly of claim 1 wherein the mount frame includes a pushplate for connecting the lift frame to the mount frame.

8. For use with a vehicle having a frame and a front bumper, a snow plow assembly, comprising:
   - a pair of spaced mount frames for connection to the vehicle frame behind the vehicle bumper,
   - a lift assembly including an A-frame, a lift frame and a snow blade, the snow blade mounted on the forward end of the A-frame,
   - the lift frame including means for pivotally connecting the rear end of the A-frame to the lift frame whereby the A-frame is free to rotate relative to the lift frame and means whereby the A-frame is free to rotate relative to the lift frame and means for releasably connecting the lift frame to the mount frames affording removal of the lift assembly from the mount frames as a single unit so as to leave the mount frames on the vehicle, the pivotally connecting means including a pair of spaced clevises, each side of the rear end of the A-frame connected to one of the clevises, the releasably connecting means located at a position behind the vehicle bumper when the lift frame is connected to the mount frames, the releasably connecting means including a pair of spaced U-shaped channels, each channel including means for horizontally aligning the channel with one of the mount frames when connecting the channels to the mount frames and defined by a pair of upstanding legs connected by a lower bight portion with the legs extending in the direction of travel of the vehicle, and each mount frame including means for vertically aligning the mount frame relative to one of the channels when connecting the channels to the mount frames.

9. For use with a vehicle having a frame and a front bumper, a snow plow assembly, comprising:

a mount frame for connection to the vehicle frame behind the bumper, a lift assembly including an A-frame, a lift frame and a snow blade, the snow blade mounted on the forward end of the A-frame, the lift frame including a clevis for connecting the rear end of the A-frame to the lift frame whereby the A-frame is free to rotate relative to the lift frame and a retractable pin connecting the lift frame to the mount frame affording removal of the lift assembly from the mount frame as a single unit so as to leave the mount frame the mount frame on the vehicle, the clevis positioned between the pin and the mount frame, and the pin located at a position behind the vehicle bumper when the lift frame is connected to the mount frame.

10. For use with a vehicle having a frame and a front bumper, a snow plow assembly, comprising:

a mount frame for connection to the vehicle frame behind the bumper, a lift assembly including an A-frame, a lift frame and a snow blade, the snow blade mounted on the forward end of the A-frame, the lift frame including means for pivotally connecting the rear end of the A-frame to the lift frame whereby the A-frame is free to rotate relative to the lift frame to the lift frame whereby the A-frame is free to rotate relative to the lift frame and means for releasably connecting the lift frame to the mount frame affording removal of the lift assembly from the mount frame as a single unit so as to leave the mount frame on the vehicle, the releasably connecting means located at a position behind the vehicle bumper when the lift frame is connected to the mount frame and including a channel having a pair of spaced guides tapering in an outwardly direction for horizontally aligning the mount frame relative to the channel when connecting the channel to the mount frame.

11. For use with a vehicle having a frame and a front bumper, a snow plow assembly, comprising:

a mount frame for connection to the vehicle frame behind the bumper, a lift assembly including an A-frame, a lift frame and a snow blade, the snow blade mounted on the forward end of the A-frame, the lift frame including means for pivotally connecting the rear end of the A-frame to the lift frame whereby the A-frame is free to rotate relative to the lift frame and means for releasably connecting the lift frame to the mount frame affording removal of the lift assembly from the mount frame as a single unit so as to leave the mount frame on the vehicle, the releasably connecting means located at a position behind the vehicle bumper when the lift frame is connected to the mount frame and including a channel for horizontally aligning the amount frame relative to the channel when connecting the channel to the mount frame, the mount frame including means for vertically aligning the mount frame relative to the channel and a pushplate for connecting the channel to the mount frame, the vertical alignment means including an upper plate spaced from a lower plate for forming a slot, the lower plate including a downwardly extending portion for guiding the channel into the slot.

* * * * *

UNITED STATES PATENT AND TRADEMARK OFFICE

CERTIFICATE OF CORRECTION

PATENT NO. : 5,353,530
APPLICATION NO. : 07/939331
DATED : October 11, 1994
INVENTOR(S) : James C. Pieper It is certified that error appears in the above-identified patent and that said Letters Patent is hereby corrected as shown below:

Column 4, line 49, reads: "of upstanding legs connected by a lower bright portion", should read: -- of upstanding legs connected by a lower bight portion --.

Column 6, Claim 1, lines 17-18, reads: "a mount frame for connection to the vehicle frame behind the bumper," These lines should be deleted. Lines 17-18 are duplicates of lines 15-16.

Column 7, Claim 8, lines 1-3, reads: "whereby the A-frame is free to rotate relative to the lift frame and means whereby the A-frame is free to rotate relative to the lift frame and means", should read: -- whereby the A-frame is free to rotate relative to the lift frame and means --.

Column 7, Claim 9, line 39, reads: "so as to leave the mount frame the mount frame on", should read: -- so as to leave the mount frame on --.

Column 8, Claim 10, lines 7-9, reads: whereby the A-frame is free to rotate relative to the lift frame to the lift frame whereby the A-frame is free to rotate relative to the lift frame and means", should read: -- whereby the A-frame is free to rotate relative to the lift frame and means --.

Signed and Sealed this
Fourteenth Day of June, 2011

David J. Kappos

David J. Kappos
*Director of the United States Patent and Trademark Office*